United States Patent [19]

Suzuki et al.

[11] 4,314,590

[45] Feb. 9, 1982

[54] WEFT GUIDING COMB FOR A JET LOOM

[75] Inventors: Hajime Suzuki, Anjyo; Yoshifumi Umemura, Toyoake; Masahiko Kimbara, Kariya; Yoshimi Iwano, Ohbu, all of Japan

[73] Assignee: Kabushiki Kaisha Toyoda Jidoshokki Seisakusho, Kariya, Japan

[21] Appl. No.: 129,410

[22] Filed: Mar. 11, 1980

[30] Foreign Application Priority Data

Mar. 14, 1979 [JP] Japan ..... 54-3014

[51] Int. Cl.[3] ..... D03D 47/30

[52] U.S. Cl. ..... 139/435

[58] Field of Search ..... 139/435; 226/97

[56] References Cited

U.S. PATENT DOCUMENTS 3,139,118 6/1964 Svaty et al. ..... 139/435

4,031,926 6/1977 Zollinger et al. ..... 139/435

4,190,067 2/1980 Kuder et al. ..... 139/435

*Primary Examiner*—Henry Jaudon

*Attorney, Agent, or Firm*—Wenderoth, Lind & Ponack

[57] ABSTRACT

Generally, a weft guiding comb according to this invention consists of a root portion, an annular portion integrally connected to the upper end of the root portion and forming an aperture with a slit, a fluid passage formed in each of said root and annular portions to allow a flow of fluid to flow therethrough, and a fluid outlet or outlets arranged around the periphery of the aperture for discharging the flow of fluid passed through said fluid passages. At least said annular portion is composed of two members each extending in the radial direction of the aperture and cooperating with each other to form said fluid passage and said fluid outlet or outlets.

6 Claims, 11 Drawing Figures

WEFT GUIDING COMB FOR A JET LOOM

BACKGROUND OF THE INVENTION

This invention relates to a jet loom, in which weft yarns are inserted into the shed by a jet of fluid, and more particularly to combs with apertures for guiding the insertion of the weft yarns.

In the jet loom of the type described above, in addition to a main nozzle positioned in alignment with the apertures of the combs, a suitable number of sub-nozzles are generally employed to assist the yarn in being fed through the shed. For example, U.S. Pat. No. 3,139,118 discloses a weft guiding comb having the functions of the above-described sub-nozzle, which comb comprises two flattened tubes and an inlay connected thereto, the tubes having air discharge openings to supply air therethrough into the space of the aperture. However, in such a weft guiding comb, since each discharge opening has to be provided only by the tube, it is very difficult to form the discharge openings in the tubes so as to distribute the air, discharged from the openings, evenly around the jet of air produced by the main nozzle. This may result in a failure of the weft insertion.

It is therefore a principal object of this invention to provide a sub-nozzle, which has a structure substantially corresponding in contour to a weft guiding comb and allowing easy formation of a plurality of fluid outlets producing jets of fluid around a jet of fluid produced by a main nozzle.

SUMMARY OF THE INVENTION

Generally, a weft guiding comb according to this invention consists of a root portion, an annular portion integrally connected to the upper end of the root portion and forming an aperture with a slit, a fluid passage formed in each of said root and annular portions to allow a flow of fluid to flow therethrough, and a fluid outlet or outlets arranged around the periphery of the aperture for discharging the flow of fluid passed through said fluid passages. At least said annular portion is composed of two members each extending in the radial direction of the aperture and cooperating with each other to form said fluid passage and said fluid outlet or outlets.

BRIEF DESCRIPTION OF THE DRAWINGS

This invention will become more readily apparent from the following description of the preferred embodiments shown, by way of example only, in the accompanying drawings, wherein.

DESCRIPTION OF THE PREFERRED EMBODIMENTS

Figure 1:
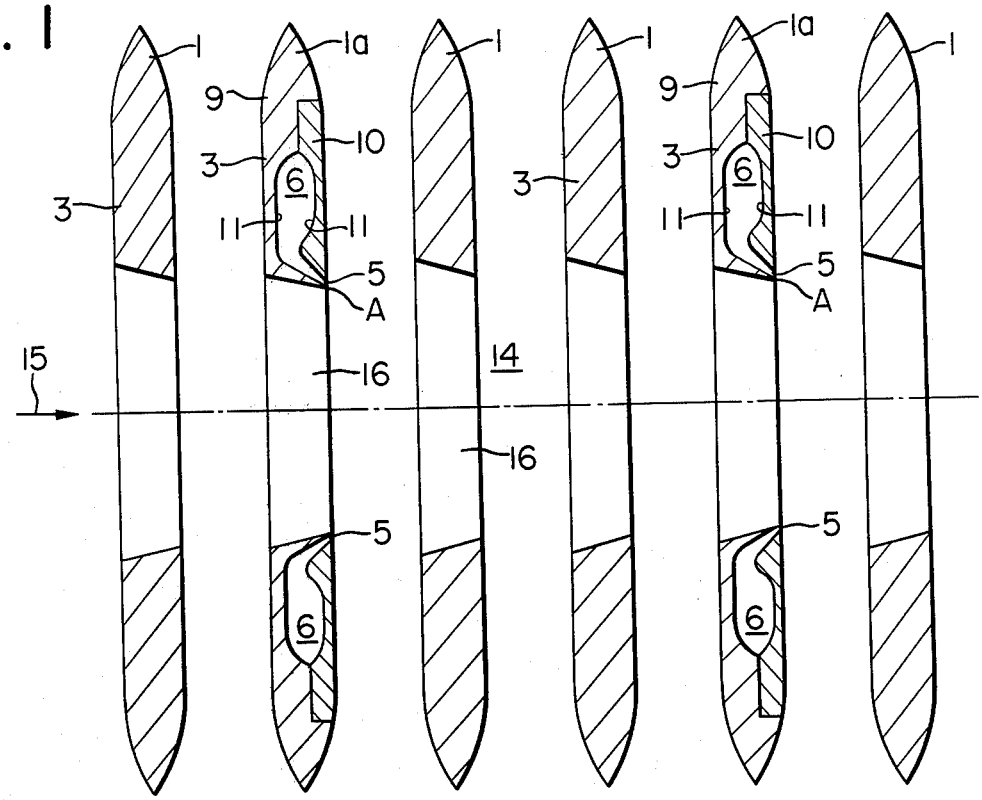
FIG. 1 is a plan view, in cross-section, of an array of weft guiding combs or members including those formed according to this invention.

Referring to FIG. 1, there is shown an array of weft guiding combs 1 and 1*a* arranged in parallel to a not shown reed of a jet loom to form a continuous channel 14, through which a weft yarn is passed during the picking in a direction shown by arrow 15.

Figure 2:
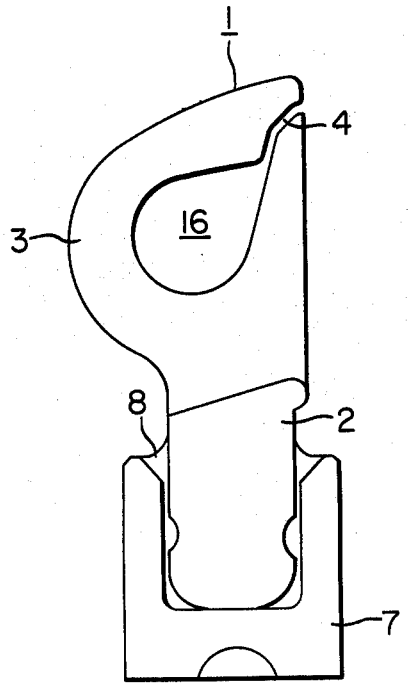
FIG. 2 is a side elevational view of the conventional weft guiding comb shown in FIG. 1.

As shown in FIG. 2, each of the guiding combs 1 consists of a straight root portion 2, which may be fixedly fitted into a U-shaped support 7 through a suitable adhesive 8, and an annular portion 3 projecting upwardly from the upper end of the root portion 2. The annular portion 3 defines an aperture 16 constituting the channel 14 (FIG. 1) and has a slit 4 formed in the upper part thereof to allow the weft yarn passed through the channel 14 to come out of the aperture 16 prior to the beating.

In suitable positions, weft guiding combs 1*a* constructed in accordance with this invention are interposed between the above-described combs 1 in alignment therewith.

Figure 3:
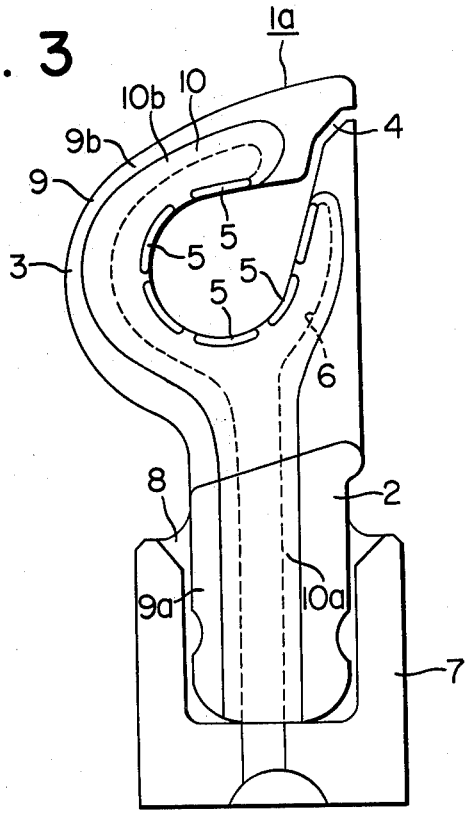
FIG. 3 is a side elevational view of the weft guiding comb formed according to this invention and shown in FIG. 1.

As shown in FIGS. 1 and 3, each of the guide combs 1*a* includes a plurality of fluid outlets 5 arranged around the downstream side of the aperture 16 so as to open into the channel 14. To supply the fluid to these outlets 5, a fluid passage 6 is provided in the root portion 2 and annular portion 3 of the comb 1*a* in fluid communication with the outlets 5. The outlets 5 are arcuated as shown in FIG. 3.

According to this invention, in order to facilitate the manufacturing of such a guide comb 1*a*, the same is constituted by two members 9 and 10 connected together by such means as welding, brazing, caulking or soldering. The first member 9 is positioned upstream of the second member 10 with respect to the weft inserting direction 15. In this embodiment, the first member 9 forms the major portion of the comb 1*a*, while the second member 10 serves as a cover for the fluid passage 6 formed in the first member 9. Therefore, the first and second members 9 and 10 comprise respectively straight portions 9*a* and 10*a* and annular portions 9*b* and 10*b* as seen in FIG. 3.

These members 9 and 10 may be manufactured by a lost wax process or a resin molding, and when assembled into the comb 1*a* the inner peripheral edge of the annular portion 10*b* of the cover 10 is adapted to closely fit that of the annular portion 9*b* of the first member 9. In the opposite surfaces of the first and second members 9 and 10, concaves 11 are formed to define the fluid passage 6. Moreover, a plurality of slots are formed in the inner peripheral edge of the annular portion 10*b* of the cover 10, thereby to provide the said fluid outlets 5 in cooperation with the inner peripheral edge of the annular portion 9*b* of the first member 9.

Although each fluid outlet 5 has an arched shape, it may be formed in a circle. In addition, the arcuated outlets 5 may be connected together to form a single outlet extending along the majority of the inner peripheral edge of the cover's annular portion 10*b*.

With the weft guiding comb 1*a* formed as above, since the fluid outlets 5 are arranged around the aperture 16 in the comb 1*a*, the jets of fluid from these outlets 5 can surround the jet of fluid produced by the main nozzle. This enables the weft inserting to be accomplished smoothly and without failure. In particular, the arcuated slots 5 surrounding the aperture 16 can contribute greatly to the formation of a uniformly distributed flow of fluid around the jet of fluid produced by the main nozzle, assuring a more reliable weft inserting.

Moreover, it is to be understood that according to this invention since the fluid passage 6 is provided by incorporating the concaves 11 with each other separately formed in the two members 9 and 10 composing the comb 1*a*, the formation of the passage 6 can be more readily achieved than providing a fluid passage in a comb of one-piece integral formation. In addition, since the fluid outlets 5 are provided at a joint A (FIG. 1) of the two members 9 and 10 by merely forming the slots in the cover 10, the formation thereof can be effected more easily.

Figures 3A, 3B:
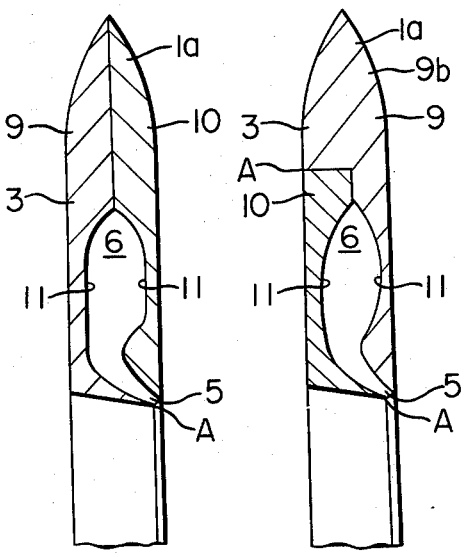
FIGS. 3A and 3B are fragmental sectional views showing modifications of the guiding comb of this invention shown in FIGS. 1 and 3.

FIGS. 3A and 3B show modifications of the embodiment shown in FIGS. 1 and 3. In FIG. 3A, the comb 1*a* is equally divided into halves 9 and 10 having substantially the same thickness. In FIG. 3B, the first member 9 forming the majority of the comb 1*a* is on the downstream side and has the slots 5 formed in the inner peripheral edge of the annular portion 9*b* thereof.

Figure 4B:
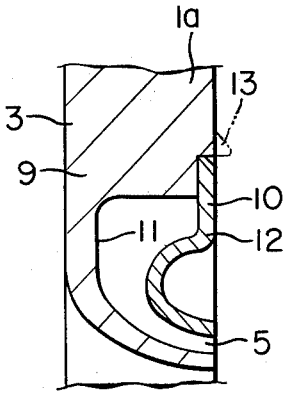
FIGS. 4A and 4B are views showing, in section, modifications of the guiding comb shown in FIG. 4.
Figures 4, 4A, 5, 5A, 6:
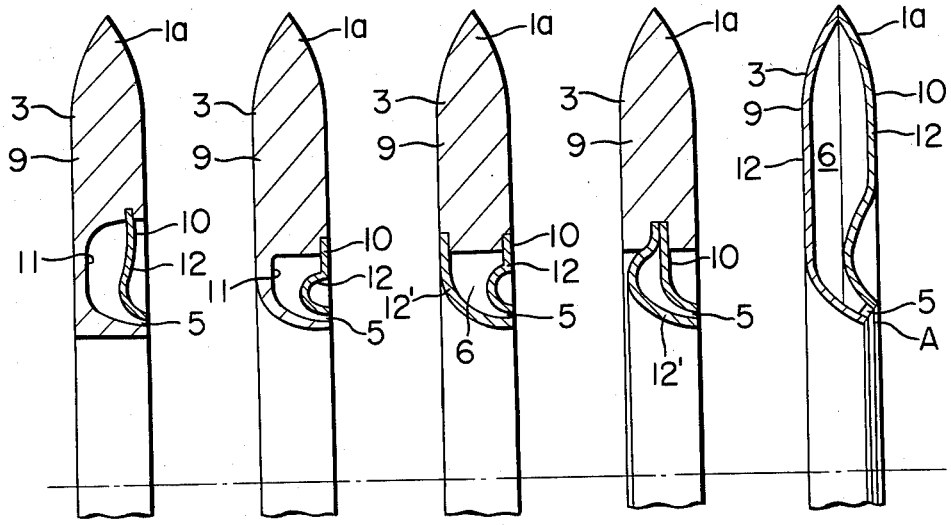
FIG. 4 is a fragmental sectional view showing another embodiment of this invention.
FIG. 5 shows, in section, still another embodiment of this invention.
FIG. 5A is a fragmental sectional view showing a modification of the guiding comb shown in FIG. 5; and, FIG. 6 is a fragmental sectional view showing a further embodiment of this invention.

In the embodiment of FIG. 4, the cover 10 comprises a metal plate 12 having an annular portion 10*b*, of which an outer peripheral edge is fixedly embeded in the wall portion of the first member 9 defining the concave 11 and an inner peripheral edge forms the fluid outlets 5 in cooperation with the inner peripheral wall portion of the first member 9 defining the concave 11. The comb 1*a* shown in FIG. 4A is substantially the same as that in FIG. 4, except that the outer peripheral edge of the cover 10 is fixedly mounted in the surface of the first member 9 by the caulking or brazing. The caulking may be performed by bulging a portion of the first member 9 as shown at 13 in FIG. 4B. Thereafter, the caulked or brazed portions may be ground. The surface of the first member 9 is preferably plated with a suitable metallic material.

In the embodiment of FIG. 5, the fluid passage 6 is formed by the cover 10 and a stainless steel plate 12′ both disposed on the inside of the first member 9 with their outer peripheral portions being caulked or brazed to the inner peripheral edge portions of the first member 9. In FIG. 5A, the outer peripheral portions of the cover 10 and the plate 12′ are fixedly connected together and then cast in the inner peripheral portion of the first member 9 when the latter is moulded by plastics.

FIG. 6 shows the comb 1*a* comprising the first and second members 9 and 10 each made up by a stainless steel plate 12 press formed in a predetermined shape. The plates 12 are connected together by welding, brazing or soldering. Between the inner peripheral edge portions of the plates, there is a slit to form a single fluid outlet 5. At least a portion or portions of the slit may be closed by the weld or solder thereby to provide a plurality of fluid outlets. Thereafter, the welded or soldered portions may be ground to remove burrs.

In the above embodiments and modifications, either or both of the first and second members may be made of stainless steel, carbon steel, aluminum or plastics.

What we claim is:

1. A weft guiding comb for a jet loom consisting of a root portion, an annular portion integrally connected to the upper end of the root portion and forming an aperture with a slit, a fluid passage formed in said root portion and said annular portion to allow a flow of fluid to flow therethrough, and outlet means arranged around the periphery of the aperture for discharging the flow of fluid passed through the fluid passages, at least said annular portion being composed of two members each extending in the radial direction of the aperture and cooperating with each other to form said fluid passage and said outlet means, said outlet means being defined by radially inward peripheral edges of said two members.

2. The weft guiding comb according to claim 1, wherein said outlet means comprises a plurality of arcuated slits circumferentially arranged around the periphery of the aperture.

3. The weft guiding comb according to claim 1, wherein said two members are cast members which have been formed by a lost wax process.

4. The weft guiding comb according to claim 1, wherein said two members are molded members which have been formed by a resin molding.

5. The weft guiding comb according to claim 1, wherein said two members are metallic plates which have been press formed in predetermined configurations.

6. The weft guiding comb according to claim 1, wherein one of said two members is mounted in the side of the other member.

* * * * *